US006168217B1

(12) United States Patent
Krüger et al.

(10) Patent No.: US 6,168,217 B1
(45) Date of Patent: Jan. 2, 2001

(54) MATING CLOSURE PART FOR A TAILGATE LOCK OR DOOR LOCK

(75) Inventors: Norbert Krüger, Essen; Andreas Nickel, Sprockhövel, both of (DE)

(73) Assignee: Ewald Witte GmbH & Co., KG, Velbert (DE)

( * ) Notice: Under 35 U.S.C. 154(b), the term of this patent shall be extended for 0 days.

(21) Appl. No.: 09/317,680

(22) Filed: May 24, 1999

(30) Foreign Application Priority Data

May 26, 1998 (DE) ..... 198 23 261

(51) Int. Cl.[7] ..... E05B 15/02

(52) U.S. Cl. ..... 292/341.16; 292/341.13; 292/201; 292/DIG. 23

(58) Field of Search ..... 292/341.13, 341.15, 292/341.16, 341.17, 341.18, 201, 216, DIG. 23, DIG. 29, DIG. 43, 340–970; 74/521, 89.15, 106, 520

(56) References Cited

U.S. PATENT DOCUMENTS 3,842,729 * 10/1974 Mandrup ..... 100/229 A
4,007,896 * 2/1977 Reynolds, III ..... 244/42 D
4,707,007 * 11/1987 Inoh ..... 292/341.16
4,746,153 * 5/1988 Compeau et al. ..... 292/216
4,842,313 * 6/1989 Boyko et al. ..... 292/341.16
4,982,984 * 1/1991 Yokota et al. ..... 292/201
5,066,056 * 11/1991 Schap ..... 292/341.16
5,746,459 * 5/1998 Giroux, Jr. et al. ..... 292/341.16
5,755,468 * 5/1998 Buchanan, Jr. ..... 292/341.16
5,765,886 * 6/1998 Buchanan, Jr. ..... 292/341.16
5,938,254 * 8/1999 Weyerstall ..... 292/341.16

FOREIGN PATENT DOCUMENTS 3839568 5/1990 (DE) .

* cited by examiner

*Primary Examiner*—B. Dayoan
*Assistant Examiner*—Clifford B Vaterlaus
(74) *Attorney, Agent, or Firm*—Martin A. Farber

(57) ABSTRACT

Mating closure part for a tailgate lock or door lock comprising a closure part with latch or the like and a mating closure part interacting therewith, having a closure member (2), in particular in the form of a closure block or closure bracket, which can be gripped by the latch and which, in order to generate a starting torque in closure direction (X), can be displaced from an open position (FIG. 3) into a closed position. The displacement of the closure member (2) is derived from the displacement of a threaded engagement part (spindle nut 3, 4) engaging in the thread of a rotationally driven spindle (5, 6).

10 Claims, 3 Drawing Sheets

MATING CLOSURE PART FOR A TAILGATE LOCK OR DOOR LOCK

FIELD AND BACKGROUND OF THE INVENTION

The invention relates to a mating closure part for tailgate lock or door lock comprising a closure part with latch or the like and a mating closure part interacting therewith.

A known lock for a tailgate of a motor vehicle comprises a closure part having a forked rotary latch which, with its fork opening, can engage a closure member of a mating closure part. In a known forked rotary latch, the engaged closure member releases a trip mechanism so that the forked rotary latch is able to pivot. The forked rotary latch is held in the pivoted position by a catch. A forked rotary latch is known, for example, from DE 3 839 568.

The associated mating closure part comprises a closure block or a closure bracket. This bracket is generally connected firmly to a securing plate which is secured on the tailgate or—if the forked rotary latch sits on the tailgate—is secured on the bodywork.

In order to overcome the relatively high forces which occur on closing a tailgate, as a result of the rubber sealing lips to be compressed, closure aids were in the past developed which, for example, provide rotational support for the rotary latch. Proposals have also already been made to take up the closure forces by means of a displacement on the mating closure part.

SUMMARY OF THE INVENTION

It is an object of the invention to provide a mating closure part of the above-described type which is more favorable from the point of view of closure technology, in order in particular to apply a high starting torque.

The object is achieved by the invention wherein in order to generate a starting torque in the closure direction, the closure member, which can have the form of a closure bracket or a closure block, can be displaced from an open position into a closed position. The displacement of the closure member is intended to derive from a displacement of a spindle engagement part, acting as spindle nut, which engages in a thread of a rotationally driven spindle. The spindle can be driven by a motor, for example. For this purpose, the spindle can have a pinion which meshes with a worm gear of a motor shaft. It is further provided that the spindle has two spindle sections which have mutually opposed thread pitches. A spindle nut can sit on each of these threads. A further concept of the invention, also of independent significance, is that the closure member displacement is effected via a scissor hinge arrangement. The closure member can in this case be assigned to the pivot pin of the scissor hinge arrangement. The scissor hinge arrangement has in particular two scissor arms which are connected to each other with a pivot pin. The two arms of the scissor hinge arrangement each engage with their free ends in the thread of the spindle. The openings provided for this purpose act as spindle nuts, which sit on the spindle sections, which have opposed threads. In a position allocated to the closed position, the two arms of the scissor hinge arrangement lie parallel to each other. This has the advantage that the forces occurring in the end stage of the torque movement are the greatest. Because of the two-part spindle, the pivoting of the two scissor hinge arms takes place synchronously in such a way that the pivot pin is displaced on a straight line transverse to the spindle direction when the two free arms or "spindle nuts" are displaced toward or away from each other.

In an advantageous development of the invention, the threaded spindle has a bearing collar in the area between the two spindle sections, by means of which bearing collar the spindle is secured on a base plate. The scissor hinge pivot is advantageously a rectilinear continuation of a bracket section. The pivot pin is guided in an oblong hole of the base plate by means of a slide collar. The frame section arranged parallel thereto likewise has, at one end, a plate which is guided in an oblong hole guide. The oblong hole guide is formed by a number of plates which lie one over the other and which, as a stack of plates, together form the base plate. The "spindle nuts", which are arranged on the arms of the scissor hinge arms, can be formed by the opposite narrow sides of an oblong hole at the end of each arm.

BRIEF DESCRIPTION OF THE DRAWINGS

An illustrative embodiment of the invention is explained below with reference to the attached drawings, in which.

DETAILED DESCRIPTION OF THE PREFERRED EMBODIMENT

Figure 1:
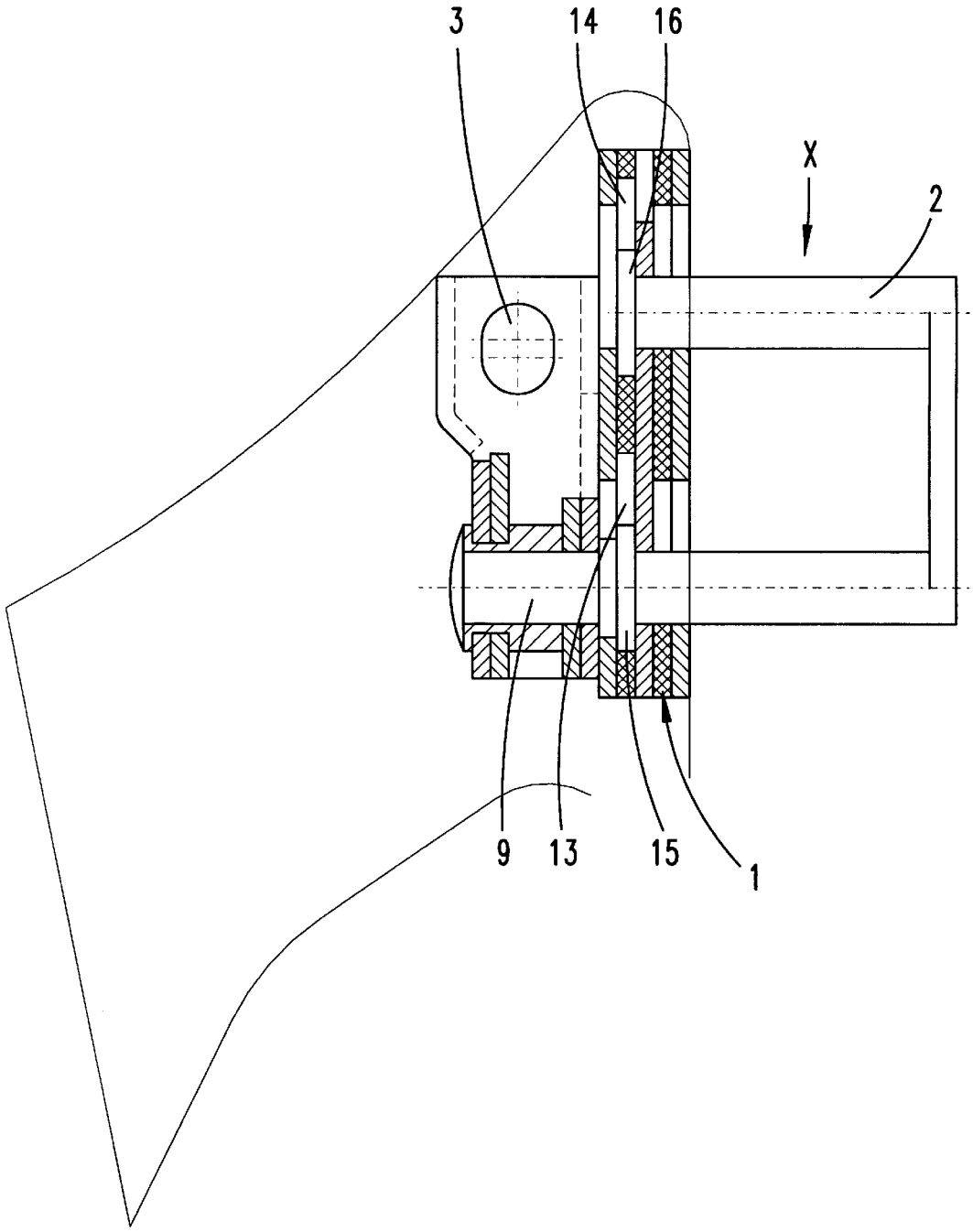
FIG. 1 shows a cross section along the line I—I in FIG. 2.

The base plate 1 of the mating closure part consists of a multiplicity of individual plates which are provided with different openings and slits and which lie one upon the other in a sandwich configuration. At least one plate of the multiplicity of plates forms two oblong holes which lie one behind the other and into which small guide plates 15, 16 of the closure bracket 2 are inserted such that they are longitudinally displaceable. These small guide plates 14 and 15 continue into the closure bracket 2. A pivot pin 9 sits on the back of one small guide plate 15. The small guide plate 15 is thus formed as a guide collar.

A hub 7 in the form of a collar of a threaded spindle sits on one side of the base plate in a bearing 12. The threaded spindle has spindle sections 5, 6 extending on both sides of the hub 7. The two spindle sections 5, 6 are each provided with external threads, one being a lefthand thread and the other a righthand thread. A spindle nut 3 in the form of an oblong hole of an arm 10 sits on the threaded spindle section 5, and a spindle nut 4 sits in a similar arrangement on the threaded spindle section 6. The spindle nuts 3 and 4 sit in arms 10, 11, which are connected to each other by a pivot pin 9. The two arms 10, 11 form, together with the pivot pin 9, a scissor hinge arrangement. If the spindle sections 5, 6 is rotated by a motor engaging on a pinion 8 sitting at one end of the spindle 9A, the two spindle nuts 3, 4 are moved either toward each other or away from each other, depending on the direction of rotation. This movement of the two spindle nuts 3, 4 results in a movement of the pivot pin 9 directed transversely thereto.

Figure 2:
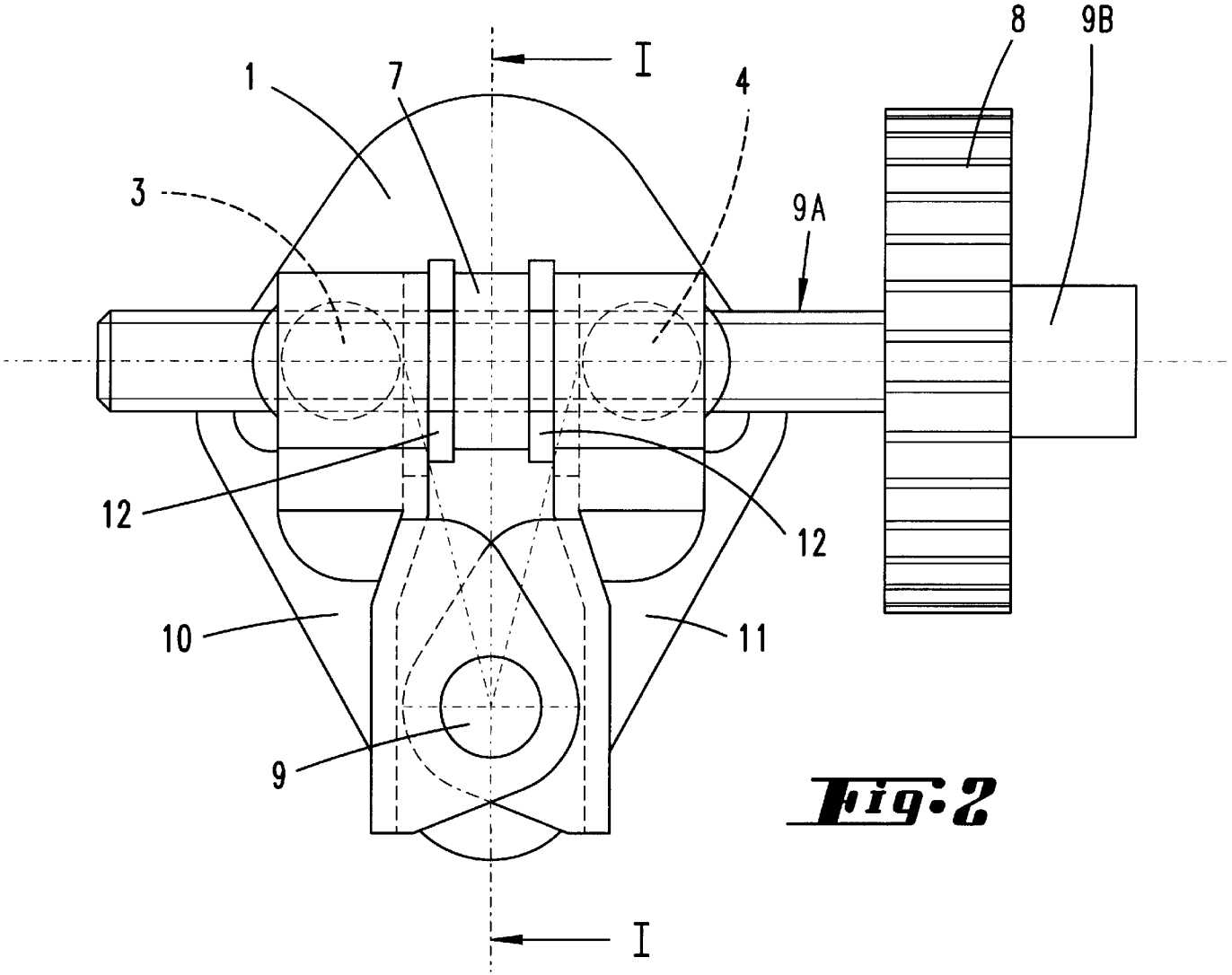
FIG. 2 shows a plan view of the mating closure part according to the invention, in a position allocated to the closed position of the lock.
Figure 3:
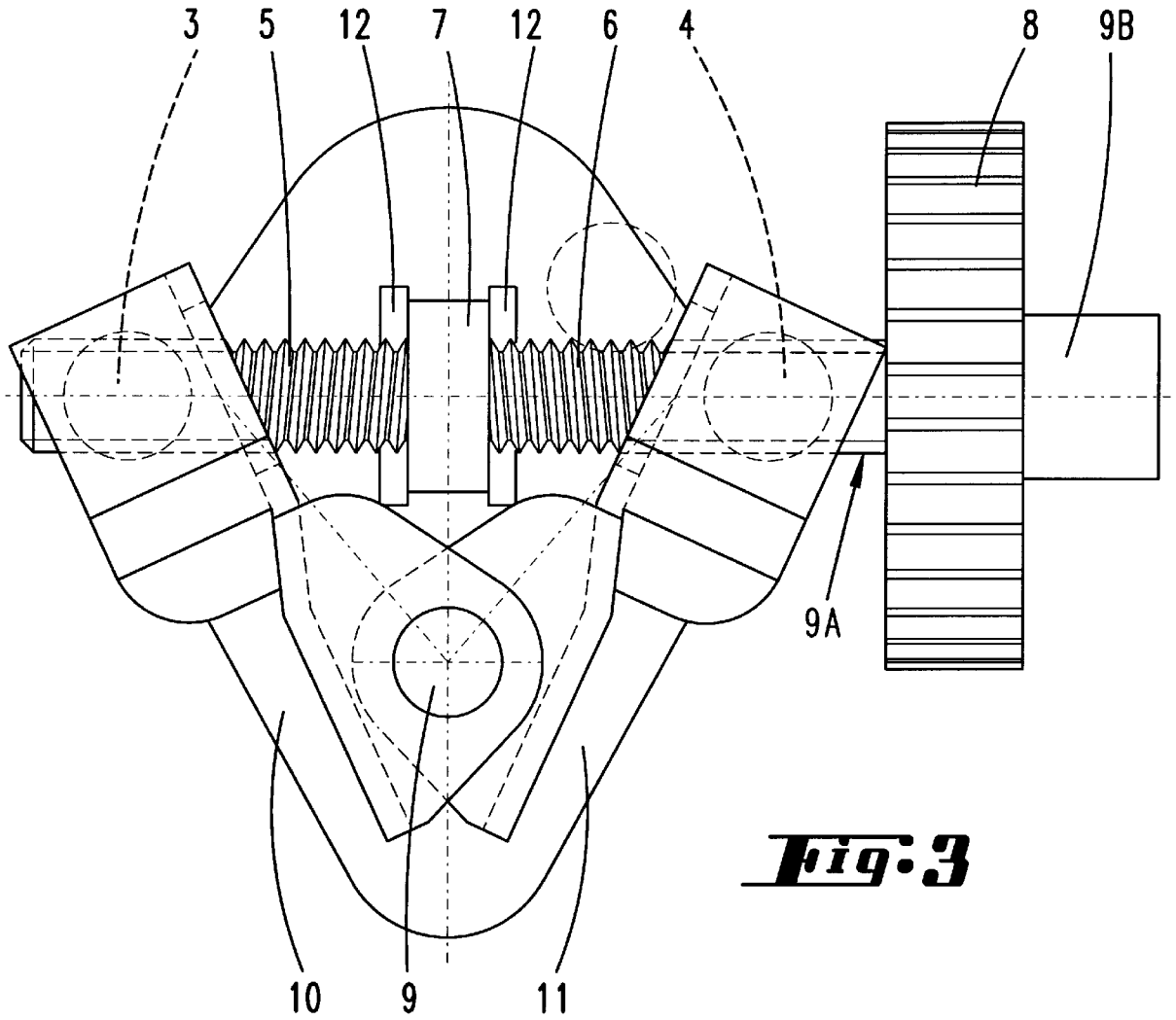
FIG. 3 shows a view according to FIG. 1, in a position corresponding to the closed position.

As has already been described above, the pivot pin 9 is part of a closure bracket 2 which cooperates with a rotary latch (not shown) of a motor vehicle tailgate lock. If, for example, the rotary latch is hooked into the closure bracket 2 in the open position shown in FIG. 3, then, by a corresponding rotational movement of the spindle 5, 6, the closure bracket can be displaced, in the direction of the arrow X, from the position shown in FIG. 3 to a position shown in FIG. 2, which corresponds to a closed position. In this displacement, the rotary latch is displaced too, so that a starting torque is exerted on the closure part bearing the rotary latch.

The mating closure part according to the invention is advantageous since the use of the spindle affords automatic locking. High opening forces can also be taken up by this. It is particularly advantageous if the arms 10, 11 of the scissor hinge arrangement lie in a parallel configuration in the closed position. The forces exerted on the spindle are then purely transverse forces.

The spindle 9A also has a bearing cam 9B at the end of the pinion 8.

The scissor hinge arrangement has two arms 10, 11 which are formed with mirror symmetry and are in particular the same length. As a result of this geometric configuration, the rotary movement of the spindle is converted into a linear displacement of the pivot pin 9, lying transverse to the spindle direction.

What is claimed is:

1. Closure assembly for a tailgate lock or door lock comprising a closure part with latch and a mating closure part interacting therewith, having a closure member (2), in particular in the form of a closure block or closure bracket, which can be gripped by the latch and which, in order to generate a starting torque in closure direction can be displaced from an open position into a closed position, the displacement of the closure member being derived from the displacement of threaded engagement parts (spindle nuts 3, 4) engaging in a thread of a rotationally driven spindle (5, 6); the spindle has spindle sections (5, 6) which each have mutually opposed thread pitches operatively connecting with respective ones of said threaded engagement parts (spindle nut 3, 4).

2. Closure assembly for a tailgate lock or door lock comprising a closure part with latch and a mating closure part interacting therewith, having a closure member (2). in particular in the form of a closure block or closure bracket, which can be gripped by the latch and which, in order to generate a starting torque in closure direction can be displaced from an open position into a closed position, the displacement of the closure member being derived from the displacement of a threaded engagement part (spindle nut 3, 4) engaging in a thread of a rotationally driven spindle (5, 6); and wherein the closure member displacement is effected via a scissor hinge arrangement.

3. Closure assembly according to claim 2 wherein the closure member cooperates with a pivot pin of the scissor hinge arrangement.

4. Closure assembly for a tailgate lock or door lock comprising a closure part with latch and a mating closure part interacting therewith, having a closure member (2), in particular in the form of a closure block or closure bracket, which can be gripped by the latch and which, in order to generate a starting torque in closure direction can be displaced from an open position into a closed position, the displacement of the closure member being derived from the displacement of threaded engagement parts (spindle nuts 3, 4) engaging in a thread of a rotationally driven spindle (5, 6);

wherein the closure member displacement is effected by a scissor hinge arrangement, and each of two arms of the scissor hinge arrangement bear at one end a respective one of said engagement part (3, 4) each of said engagement parts having an internally threaded section.

5. Closure assembly according to claim 4 wherein the two arms of the scissor hinge arrangement, in the closed position, are in a parallel or approximately parallel position.

6. Closure assembly according to claim 1 wherein the threaded spindle sections (5, 6) support a bearing collar (7) in an area between the spindle sections.

7. Closure assembly according to claim 1 further comprising a drive pinion (8) located on the spindle for rotation therewith.

8. Closure assembly according to claim 1 further comprising a base plate (1), and wherein the closure bracket (2) includes slide collars (15, 16) which are guided in oblong holes (13, 14) of the base plate (1).

9. Closure assembly according to claim 8 wherein the base plate is built up from a multiplicity of plates lying one over the other and with different oblong hole widths.

10. Closure assembly according to claim 4 wherein a base plate comprises a multiplicity of plates lying one over the other and having different elongated oblong hole widths, plates of said multiplicity of plates serving as said engagement parts of which the internally threaded sections are formed by opposite long edges of the oblong holes.

* * * * *